US006589343B1

(12) United States Patent
Egeland

(10) Patent No.: US 6,589,343 B1
(45) Date of Patent: Jul. 8, 2003

(54) DEVICE FOR APPLICATION OF DOPE ON MALE THREADS

(75) Inventor: Terje Egeland, Søgne (NO)

(73) Assignee: Maritime Hydraulics AS, Kristiansand (NO)

( * ) Notice: Subject to any disclaimer, the term of this patent is extended or adjusted under 35 U.S.C. 154(b) by 0 days.

(21) Appl. No.: 09/763,787

(22) PCT Filed: Aug. 30, 1999

(86) PCT No.: PCT/NO99/00269

§ 371 (c)(1),
(2), (4) Date: Mar. 26, 2001

(87) PCT Pub. No.: WO00/14375

PCT Pub. Date: Mar. 16, 2000

(30) Foreign Application Priority Data

Sep. 8, 1998 (NO) ..... 19984130

(51) Int. Cl.[7] ..... B05C 5/00

(52) U.S. Cl. ..... 118/315; 118/313; 118/DIG. 11; 118/323

(58) Field of Search ..... 118/313, 323, 118/300, 315, DIG. 11; 239/752; 15/88

(56) References Cited

U.S. PATENT DOCUMENTS

| | | | | | |
|---|---|---|---|---|---|
| 2,642,034 | A | * | 6/1953 | Griffin et al. | 118/317 |
| 4,011,617 | A | * | 3/1977 | Toelke et al. | 15/104.04 |
| 4,014,062 | A | * | 3/1977 | Scott et al. | 15/104.04 |
| 4,157,096 | A | * | 6/1979 | Miller, Jr. | 134/111 |
| 4,895,205 | A | | 1/1990 | Thompson et al. | |
| 5,372,154 | A | | 12/1994 | Bee et al. | |
| 5,924,432 | A | * | 7/1999 | Thies et al. | 134/174 |

FOREIGN PATENT DOCUMENTS

| | | |
|---|---|---|
| NO | 173893 | 11/1993 |
| NO | 179920 | 9/1996 |

* cited by examiner

*Primary Examiner*—Richard Crispino
*Assistant Examiner*—Michelle Acwedo Lazor
(74) *Attorney, Agent, or Firm*—Knobbe, Martens, Olson & Bear, LLP

(57) ABSTRACT

The invention concerns a device for application of dope on male threads, comprising a swivel motor (3), the swivel motor operating a rotatable top (6), on said top at least one dope application nozzle (7) being arranged. The dope application nozzle (7) is arranged at a distance from the rotational axis of the top (6), said distance being larger than the radius of a thread section to be doped.

11 Claims, 4 Drawing Sheets

DEVICE FOR APPLICATION OF DOPE ON MALE THREADS

BACKGROUND OF THE INVENTION

1. Field of the Invention

The present invention pertains to a device for application of dope on male threads, comprising a swivel motor, the swivel motor operating a rotatable top, on said top at least one dope application nozzle being arranged.

2. Description of the Related Art

It is known to provide a series of devices for doping of threads, that is devices for application of grease on the threads at the ends of drill pipes, to facilitate the joining and disengagement of pipes in a drill string.

This work used to be performed completely by manual labour by a worker applying the grease with a brush. Due to the heavy work schedule, there is seldom time enough to clean the threads before applying the grease. The work was also high-risk because of the heavy pipes being transported over the drill floor. The drill floor is in general a dangerous working place, and a demand for reduced personnel on the drill floor exists.

There have been machines developed to facilitate the application of the dope, but the majority of these machines still require one worker to be present to operate the machine.

A device, which can be remotely operated is shown in NO 173.893, which shows a device in which the thread grease is applied on male threads, or pin end, by a brush roller. The end of the pipe is according to this device lowered onto a centering means, where after the roller shaped brush is rotated around the pipe end.

U.S. Pat. No. 2,642,034 shows a hand operated device for spraying thread grease on the female end, or the box end, of the pipe. In this case a mouthpiece with one or more nozzle is fed into the pipe end and may optionally rotate in this position.

NL 8800247 shows a hand operated device for applying thread grease on a female end.

DE 2620526 shows devices for applying thread grease on female or male ends, which also are hand operated.

DE 3537633 shows a similar device to the above, which is also hand operated.

U.S. Pat. No. 4,043,295 shows a device for application of dope on female threads. It comprises a head having a nozzle for spraying dope. The dope is bent sideways by an air jet emitted sideways from an air nozzle. The air nozzle is rotatable around the longitudinal axis of the head. The device can be hand held or remotely operated.

NO 179.920 also shows a device for application of dope on female threads. It comprises a sideways directed nozzle which is rotatable around its longitudinal axis. This device must be inserted into and removed from the female end by hand.

U.S. Pat. No. 5,653,819 shows a device for cleaning of male or female threads. The threads to be cleaned are inserted into a chamber and rotationally mounted spray nozzles inside this chamber perform a cleaning action. No application of dope is described.

U.S. Pat. No. 4,895,205 shows a device for cleaning and chemical treatment of sections of pipe. The pipe is fed through a tunnel, and non-rotational spray nozzles perform treatment of the outside of the tube. No application of dope is described.

Most of the above prior art devices are hand held devices, which require one or more persons to be present near the pipe end.

Such manual labour is both high-risk and physically heavy, and there is therefor a desire to eliminate the need for a person to be present by the pipe end to apply the thread grease.

The device according to NO 173.893 functions fairly well, but it has certain disadvantages. It has inter alia no possibility for efficient cleaning of the threads before the thread grease is applied. When a pipe end is brought into a position over the device, the pipe end must be centered quite accurately over the centering means, where after the pipe tube is lowered onto the centering means or the centering means is lifted up to the pipe end. This consumes a relatively long time, and a risk exists that the pipe end does not hit the centering means.

U.S. Pat. No. 4,043,295 and NO 179.920 can only be used for doping female threads and cannot be used for male threads.

The object of the present invention is to provide a dope application device, which functions with increased efficiency and which has a simple construction and can be used for application of dope on the male threads.

SUMMARY OF THE INVENTION

The above features are achieved by arranging the dope application nozzle at a distance from the rotational axis of the top, said distance being larger than the radius of a thread section to be doped.

It is also an object of the present invention to provide a dope application device, which cleans the threads before the application of the grease.

The dope application according to the present invention can in an easy way be placed between the pipe racks on a rig of the RamRig® type. In this way the dope can be applied just before the pipe is placed in the ramp which transports it up to the drill floor. The device can also be placed on the drill floor on a separate arm or on the so called rouchneck.

BRIEF DESCRIPTION OF THE DRAWINGS

The invention will now be more closely described under reference to the accompanying drawings, in which.

DETAILED DESCRIPTION OF THE PREFERRED EMBODIMENTS

Figure 1:
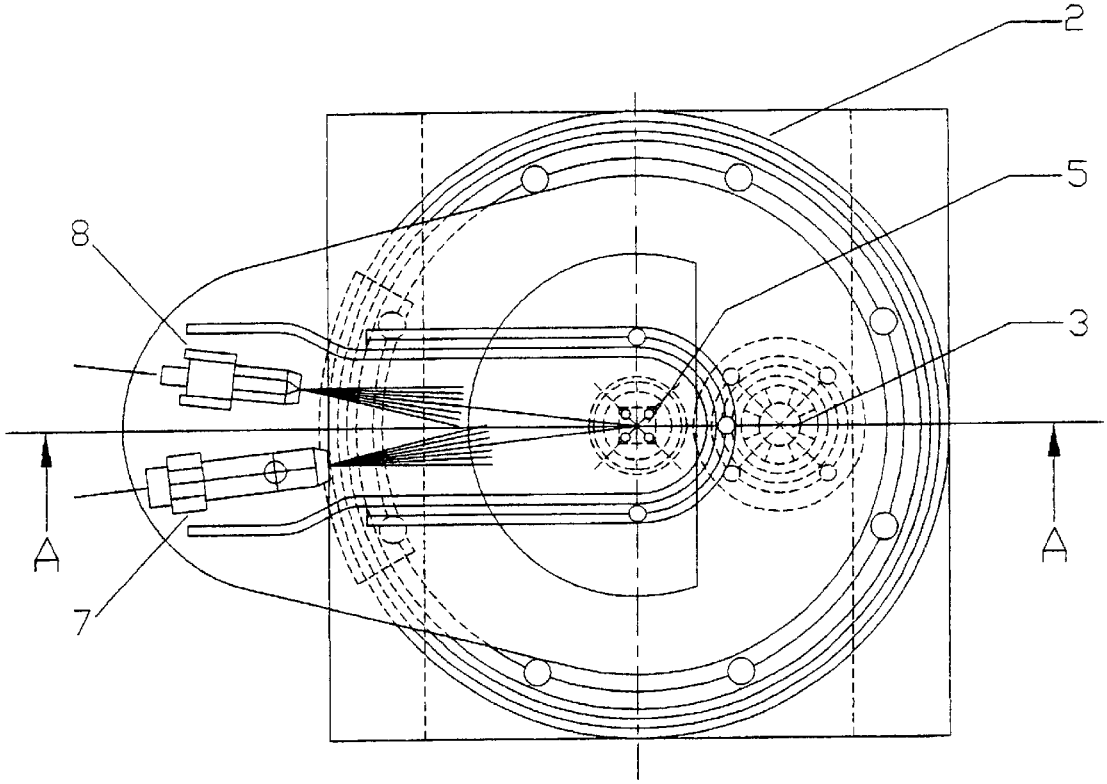
FIG. 1 shows the device according to the invention from the side.
Figure 2:
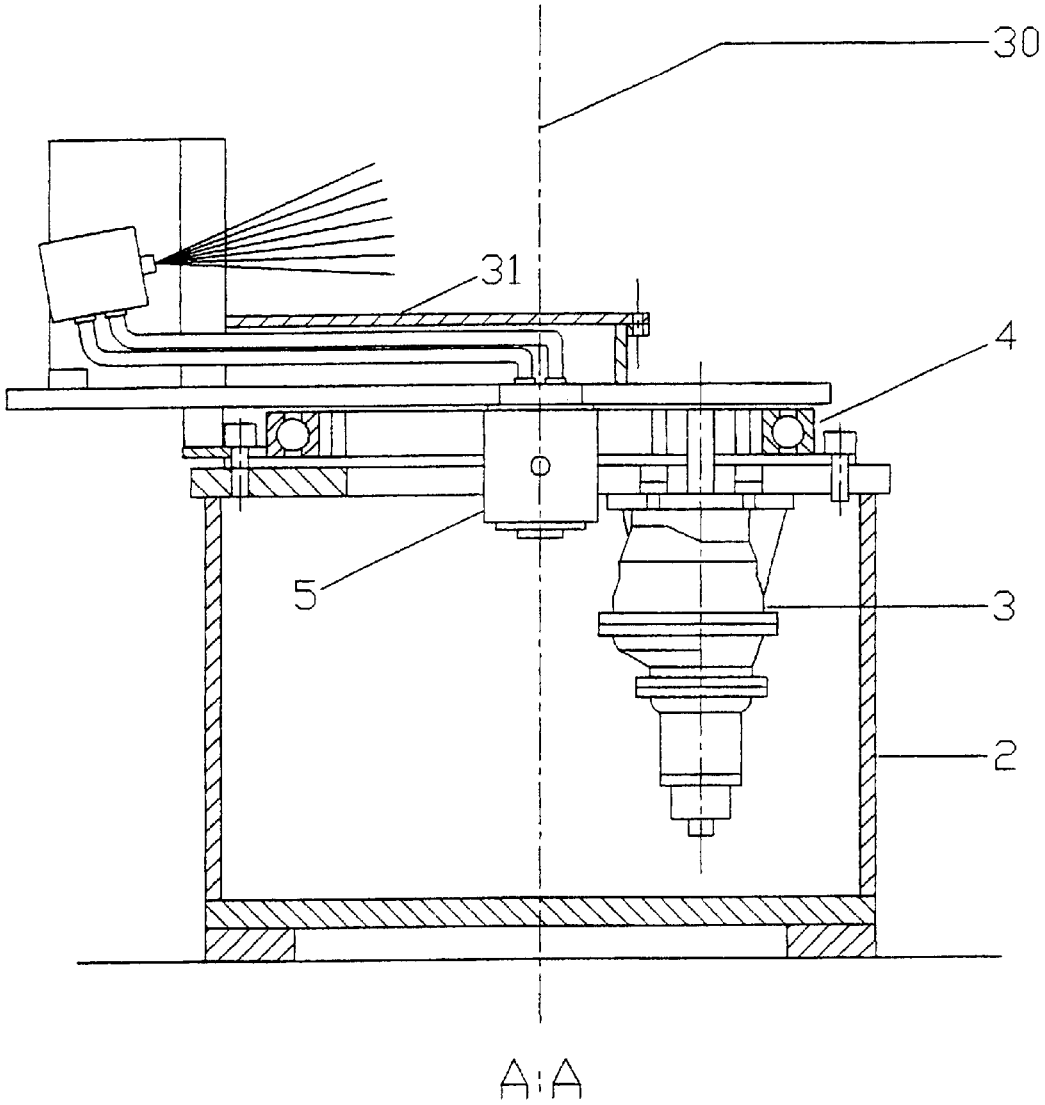
FIG. 2 shows the device according to the invention from above.
Figure 3:
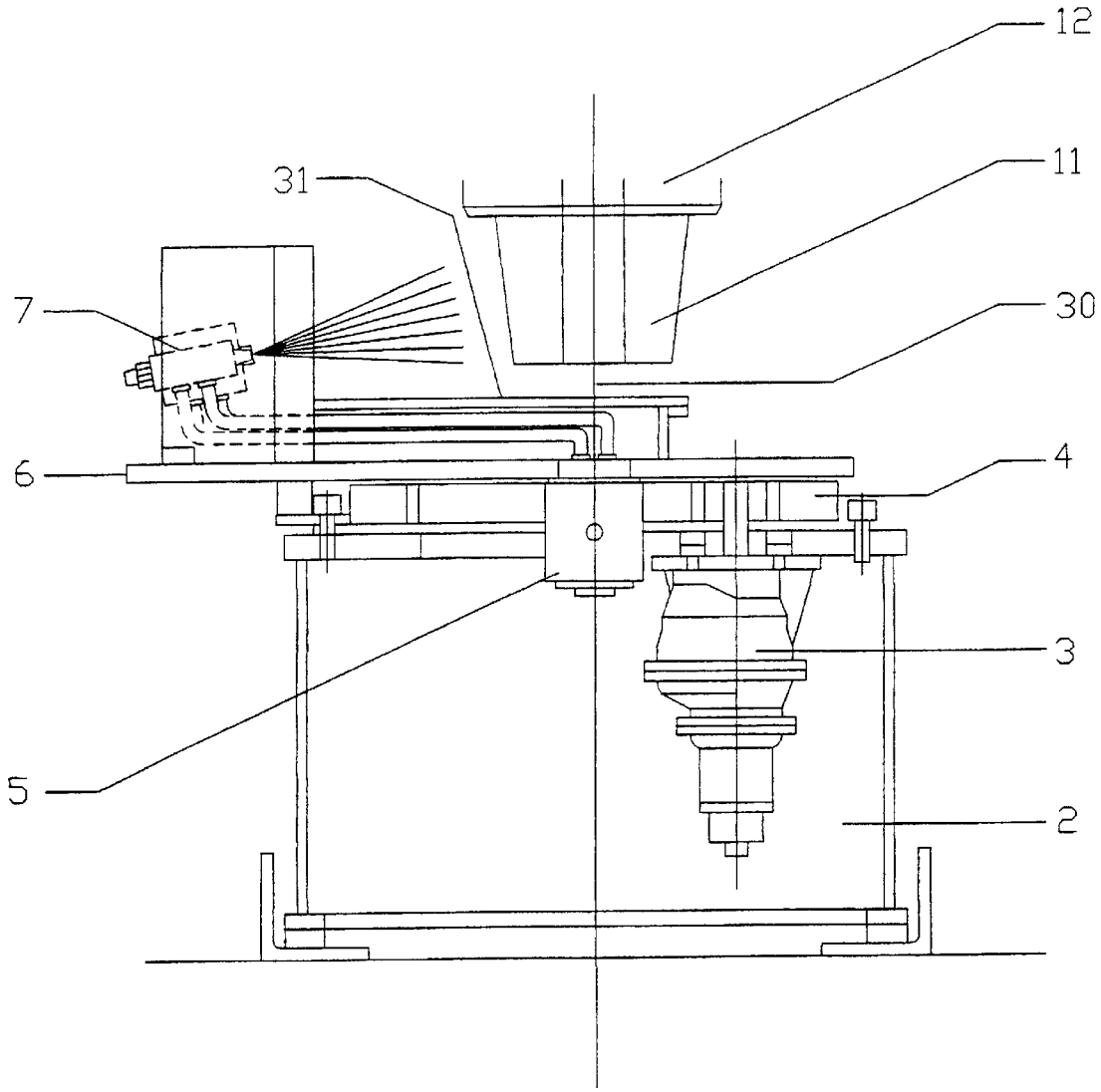
FIG. 3 shows a cross section along the line A—A in FIG. 2.

FIG. 1 shows a device according to the invention from the side. FIG. 2 shows the device from above and FIG. 3 shows a cross-section along the line A—A of FIG. 2. The device comprises a housing 2, wherein a swivel motor 3, a slew ring bearing 4, a swivel coupling 5 and a rotatable top 6. The top is rotatable around a rotational axis 30. The rotatable top 6 comprises an arm 31, extending from the rotational axis 30 of the top 6. On the opposite end of the arm 31 a nozzle 7 for dope is mounted. As shown in FIGS. 1 and 2, a nozzle 8 for water or other cleaning fluid is also mounted on the arm 31 near the dope application nozzle 7. The top 6 (shown in FIG. 3) is coupled to the swivel motor 3 via the slew ring bearing 4, so that the top 6, and the arm 31, can turn over an angle of at least approximately 360° around the rotational axis 30. Ducts (not shown) for dope and cleaning fluid are led through the swivel coupling 5.

Figure 4:
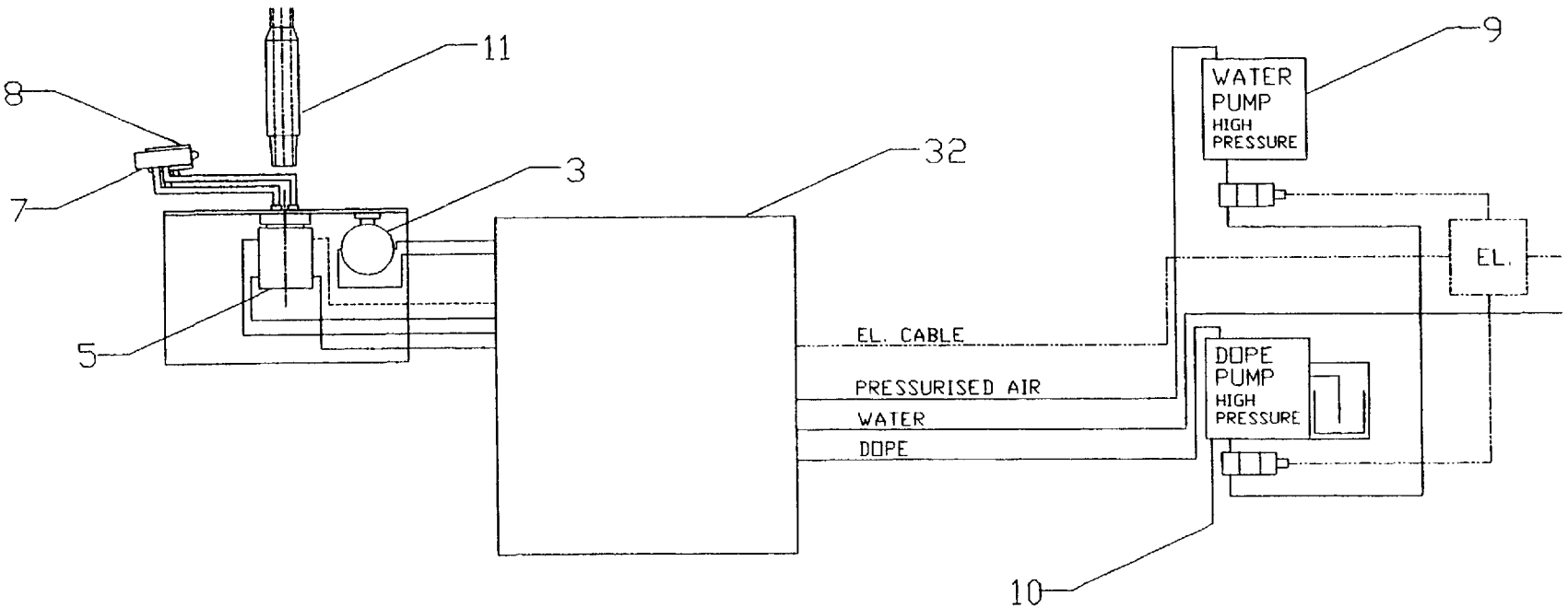
FIG. 4 shows a circuit diagram for pneumatic actuation of the device.

FIG. 4 shows a circuit diagram for the pneumatics which operates the swivel motor, the water spraying and the dope application. Here is shown a cleaning fluid pump 9 and a dope pump 10. The swivel motor 3, the swivel coupling 5, the arm 31 (FIGS. 2 and 3) with the dope application nozzle 7 and the cleaning fluid nozzle 8 are also shown. Also a control circuit 32 for controlling the cleaning fluid and dope pressure and the swivel motor is shown. This circuit can be made easily by a person of skill given the task and is therefor not described in any detail here. When one of the pumps 9, 10 is started the pressure of the cleaning fluid or the dope actuates valves in the control circuit to simultaneously set the swivel motor 3 into rotation. The arm 31 has a predefined initial position, in which it always will be when the motor 3 is stopped.

When a thread section 11 at the end of a drill pipe 12 is to be doped, the end of the pipe is moved to a position over the dope application device. This is preferably performed in a linear horizontal motion, without the need for the thread section to be centered accurately over the dope machine. The pump 9 for the cleaning fluid is started and, as described above, the swivel motor 3 is set into rotation by the pressure of the cleaning fluid actuating the control circuit 32. The top 6 with the nozzle 7 is rotated one or more revolutions and is stopped again by the control circuit when the nozzle 8 has reached the initial position. The pump 9 is stopped and the pump 10 is started and the pressure of dope fluid is allowed to build up. The dope fluid pressure actuates the control circuit to start the rotation of the swivel motor 3 in the same or in the opposite rotational direction. The dope is simultaneously applied to the threads through the nozzle 7. When the top 6 has reached the initial position again, the swivel motor 3 and the pump 10 are switched off. The drill pipe 12 is moved onward for storage or coupling to the drill string.

What is claimed is:

1. A device for applying dope to male threads of a thread section, the male threads having a radius, the device comprising:

a top rotatable about a top axis;

a swivel motor driving the rotatable top; and at least one dope application nozzle arranged on the top so as to define a rotational plane of the dope application nozzle wherein the at least one dope application nozzle is positioned, circularly further than the radius of the male threads from the top axis and to apply the dope generally radially towards the top axis and so as to define an open path across the top so as to be generally coplanar with the rotational plane of the dope application nozzle such that a thread section is rectilinearly movable through the path.

2. The device of claim 1, wherein one side of the rotational plane of the dope application nozzle is free from non-moving portions of the device.

3. The device of claim 1 wherein the dope application nozzle is mounted on an arm extending from the top axis wherein the arm comprises at least part of the top.

4. The device of claim 1, further comprising a spray nozzle for cleaning the male threads arranged so as to be rotatable about the top axis.

5. The device of claim 4, wherein the spray nozzle for cleaning the male threads is mounted so as to be at least one of co-rotational with and adjacent the dope application nozzle.

6. The device of claim 5, wherein the top is arranged to rotate approximately one revolution in first direction for cleaning the male threads and approximately one revolution in the opposite direction for applying the dope.

7. A device for applying fluid to an exterior thread surface of a thread section comprising:

a housing;

a top rotatably attached to the housing;

a swivel motor in communication with the top so as to induce rotational movement of the top about a top axis;

at least one fluid nozzle attached to the top so as to define a rotational plane of the fluid nozzle and directed generally radially to the top axis and so as to define an open path across the top so as to be generally coplanar with the rotational plane of the fluid nozzle such that a thread section is rectilinearly movable through the path; and at least one fluid pump attached to the housing wherein the pump selectively pressurizes at least one fluid to both eject the at least one fluid from the fluid nozzle and induce the swivel motor to rotate the top so as to apply the ejected fluid to the exterior thread surface generally radially to the top axis.

8. The device of claim 7, wherein the at least one fluid comprises a lubricant.

9. The device of claim 7, wherein the device applies lubricant fluid with a first nozzle and cleaning fluid with a second nozzle.

10. The device of claim 9, wherein the first and second nozzle are at least one of adjacent and corotational.

11. The device of claim 9, wherein a first pump pressurizes the lubricant fluid and a second pump pressurizes the cleaning fluid and wherein both the first and second pumps are adapted to independently activate the swivel motor upon pressurizing the corresponding fluid.

* * * * *